United States Patent [19]

De Deugd

[11] 4,213,323

[45] Jul. 22, 1980

[54] METHOD AND APPARATUS FOR EXTRUDING A BURRED EDGE OF A HOLE IN A METAL SHEET

[75] Inventor: Johannes A. G. De Deugd, Eindhoven, Netherlands

[73] Assignee: U.S. Philips Corporation, New York, N.Y.

[21] Appl. No.: 859,644

[22] Filed: Dec. 12, 1977

[30] Foreign Application Priority Data

Dec. 20, 1976 [NL] Netherlands ..... 7614120

[51] Int. Cl.[2] ..... B21D 22/00

[52] U.S. Cl. ..... 72/358; 72/370

[58] Field of Search ..... 72/356, 358, 370, 379, 72/335, 336

[56] References Cited

U.S. PATENT DOCUMENTS

| | | | |
|---|---|---|---|
| 3,812,704 | 5/1974 | Kowal | 72/370 |
| 4,055,067 | 10/1977 | Kozima | 72/356 |

*Primary Examiner*—Leon Gilden

*Attorney, Agent, or Firm*—David R. Treacy

[57] ABSTRACT

Method and apparatus for extruding burr holes in a metal sheet, in which a punch with a conical end portion and adjoining cylindrical portion of a diameter greater than the inner burr diameter is passed through the burr. The conical end portion has a half apex angle between 10° and 20°, and the axial length of the cylindrical portion and the coefficient of friction between the cylindrical portion and the burr wall are selected according to a specified relationship.

6 Claims, 4 Drawing Figures a b c

METHOD AND APPARATUS FOR EXTRUDING A BURRED EDGE OF A HOLE IN A METAL SHEET

Figure 1:
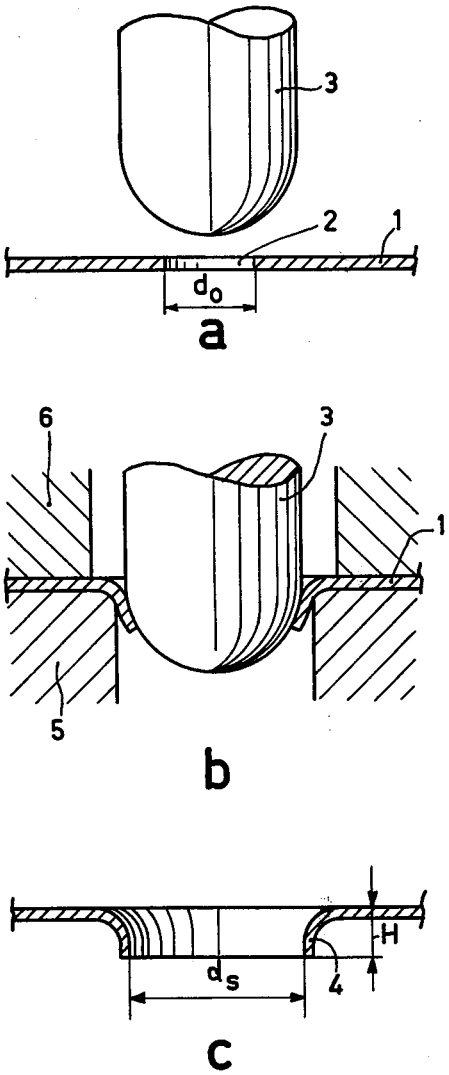

The invention relates to a method for the extrusion of burred edges of holes in a metal sheet, the sheet being supported by a die which surrounds the outside of the burr, after which at least one punch with a conical end portion and an adjoining cylindrical portion of a diameter greater than the inner diameter of the burr is passed through the burr, so that the burr is given a greater length and a smaller wall thickness.

Sheets in which holes with burred edges are formed are frequently used in practice. Sometimes a screw thread is tapped in these burrs, or they are used for mounting bearings or for the passage of spindles. For these applications the burrs generally need not be very high and accurate.

In some new applications this type of burr is employed to shape an electrostatic field in a specific manner. This type of burred edge should comply with very stringent requirements in respect of accuracy. Furthermore, the burr heights should be greater than those so far obtained in a satisfactory and reproducible manner.

It is an object of the invention to provide a method and apparatus which enable burred edges to be extruded accurately, with good surface quality, and with a minimum of rejects. In this respect the term "extrusion" is to be understood to mean an operation in which the burr wall is "smeared out" so as to obtain a thinner and higher burred edge.

The method in accordance with the invention is characterized in that a punch is selected which has a conical end portion whose half apex angle lies between 10° and 20°, and an axial length l of the cylindrical portion, coefficient of friction m between said portion and the burr wall, and ratio $S_k/S_v$ between the burr wall thickness $S_k$ before the operation and the burr-wall thickness $S_v$ after the operation satisfying the relationship $$1 \leqq \frac{S_v\sqrt{3}}{m} - 2\ln\frac{s_k}{S_v}.$$

When the above relationship between the wall thinning which is produced, the geometry of the punch and the coefficient of friction is satisfied, it is found that burred edges of great length and good surface quality can be produced with very few rejects. A process which so far was considered to be hard to control is now found to be realizable in a very successful and reproducible manner because the steps are comparatively simple.

In accordance with a further suitable variant of the inventive method, adjoining the cylindrical portion of the punch, at the side remote from the conical end portion, is a further conical portion having a half apex angle between 3° and 7° tapering to a diameter less than the cylindrical portion diameter. As a result of this, the friction between the punch and the burr is reduced.

In accordance with the inventive method a specified thinning of the burr wall and thus a specific increase in burr height per operation can be obtained. For greater burr heights the operation is repeated a number of times. This may be effected with a number of separate punches or a number of punches which are rigidly connected to each other, all the punches individually satisfying the afore-mentioned relationship.

In order to ensure that during the first extrusion operation after the burred edges have been formed the entire burr wall is reduced, the diameter of the cylindrical portion of the punch and the die, in accordance with a further preferred variant of the method, is selected so that $$S_V \leqq S_o\sqrt{do/(ds-So)}$$

where $S_v$ = burr wall thickness after extrusion
So = sheet thickness
do = hole diameter before burring
ds = inner burr diameter.

In practice it is found to be advantageous to adhere to a maximum value of 1 for the coefficient of friction. In that case any fluctuations in the conditions of friction during manufacture then no longer result in breakdown of the burrs.

The invention also relates to a sheet with one or more extruded burr holes formed in accordance with the inventive method.

Furthermore the invention relates to a punch and die set for carrying out the method in accordance with the invention.

The invention will be described in more detail with reference to the drawing.

FIGS. 1*a, b, c* schematically show how a hole in a metal sheet can be burred so as to obtain a burred edge.

FIGS. 2*a, b, c* schematically show how, starting from a burr of specific height, a burr of greater height and reduced wall thickness can be obtained.

Figure 3:
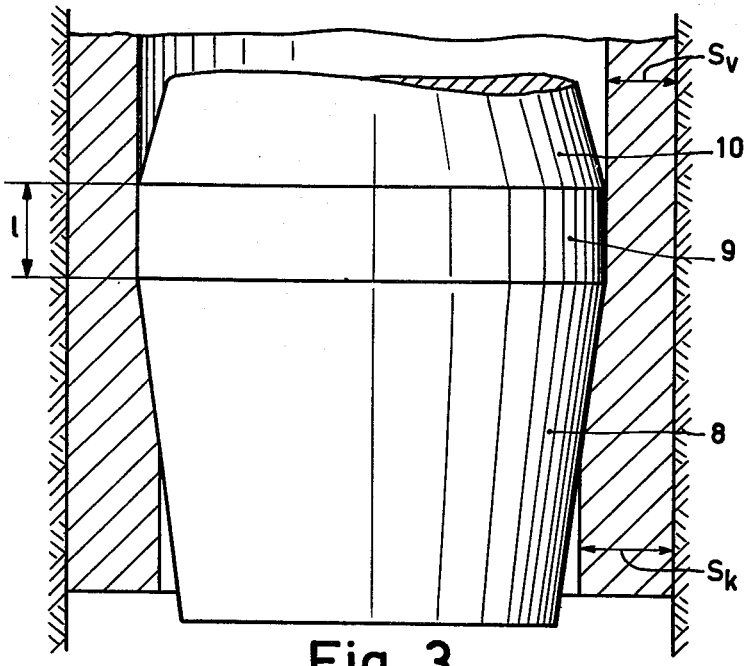

FIG. 3 on an enlarged scale shows the essential part of a punch for the extrusion of burred edges.

Figure 4:
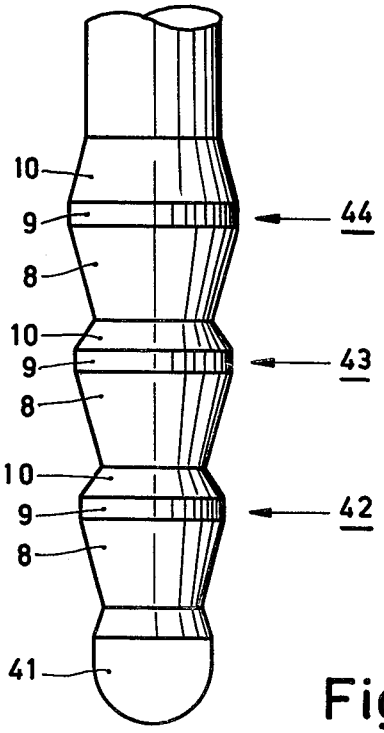

FIG. 4 shows a compound extruding punch for performing the method of FIGS. 1*a, b, c.*

FIG. 1*a* in cross-section shows a sheet 1 with a hole 2 having a diameter $d_o$. The thickness of the sheet 1 is designated $S_o$.

FIG. 1*b* shows how the edge of the hole 2 can be burred with the aid of a punch 3, so as to obtain a burr 4 with a height H. During this burring operation the sheet 1 is supported by a die 5 on its underside and is retained by a blank holder 6 on the other side.

FIGS. 2*a, b, c* show how a burr 4 of a height H is formed into a burr 8 of substantially greater height with the aid of a punch 7. The punch 7, whose essential part is shown enlarged in FIG. 3, then comprises a concial end portion 8 having a half apex angle $\alpha$ of 15°. This conical end portion 8 adjoins a cylindrical portion 9 whose diameter is greater than the inner diameter of the burr 4. The cylindrical portion 9 continues as a further conical portion 10 whose half apex angle is 5°.

The axial length l of the cylindrical portion 9 of this punch has been selected so that the following relationship is satisfied.

$$1 \leqq \frac{S_v\sqrt{3}}{m} - 2\ln\frac{S_k}{S_v}$$

where $S_k$ = burr wall thickness before extrusion
$S_b$ = burr wall thickness after extrusion
m = the coefficient of friction between the punch and burr wall.

When this relationship is satisfied it is found that the height of the burr 4 can be increased substantially, yet maintaining a satisfactory surface quality without the occurence of cracks in the burr.

Satisfying this relationship means that for a specific punch with a specific length l of the cylindrical portion the maximum permissible burr wall reduction is given by the formula $$\left(\frac{S_k}{S_v}\right)_{max} = 1\,\frac{\sqrt{3}}{2} - \frac{m\,1}{2\,S_v}$$

Conversely, when a specific burr wall reduction is to be obtained, the punch may be proportioned so that the following relationship is satisfied $$1 = \frac{S_v\sqrt{3}}{m} - 2\ln\frac{S_k}{S_v}$$

In practice it is advisable to adhere to the maximum value 1 for m, so that any fluctuations during the process have no adverse effects. When an edge is burred normally as discussed with reference to FIG. 1 and subsequently the entire burr wall is to be reduced, allowance is to be made for the fact that during burring the burr wall is thinned down towards the end.

If nevertheless the entire burr wall is to be reduced, the gap between the cilindrical portion 9 of the punch and the die should at least equal the smallest material thickness or, as has been found, the gap should be $$\leqq S_o\sqrt{d_o/(d_s-S_o)}$$

where:

$S_o$=sheet thickness $d_o$=hole diameter $d_s$=inner burr diameter

Figure 2:
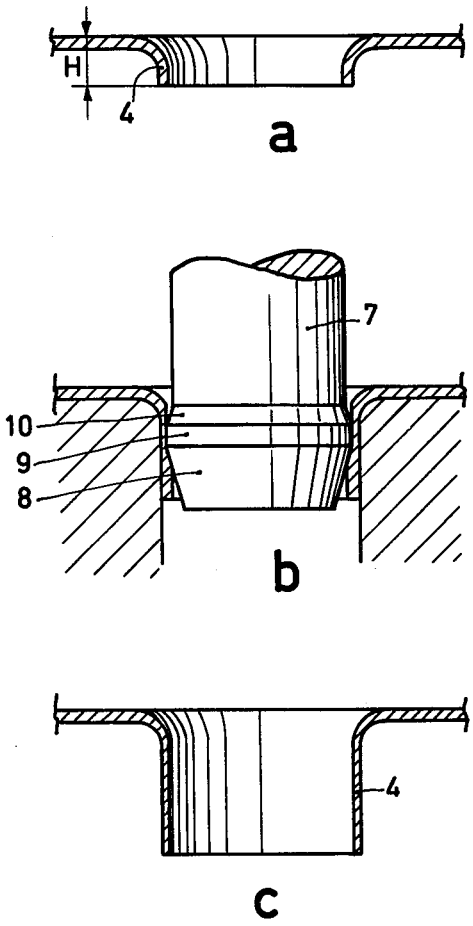

FIGS. 1, 2 and 3 show how the operation is performed in a number of individual steps, FIGS. 2 and 3 showing only one extrusion operation. Generally, in order to obtain a specific burr height, several extruding operations will be required. This can be effected with a number of separate punches or with one compound extruding punch, as is schematically shown in FIG. 4. This punch comprises a first punch portion 41 for burring the edge of the hole and a number of punch sections 42, 43, 44 for the extrusion of the burr wall. Each of the punch sections 42, 43, 44 in their turn comprise a leading conical portion 8, a cylindrical portion 9, and a trailing conical portion 10. The portions 8, 9 and 10 of each to the punch sections 42, 43 and 44 again satisfy the relationship as elaborated hereinbefore.

From the foregoing it will be apparent that the invention provides a method and apparatus which enables burred edges to be extruded in a reproducible and reliable manner up to heights which so far were not or were hardly attainable.

What is claimed is:

1. A method of extruding a burr edge of a hole in a metal sheet, from a burr wall thickness $S_k$ to a wall thickness $S_v$ after extrusion, comprising supporting the outside of the burr by a die, selecting a punch having a conical end portion with a half apex angle between 10° and 20°, and an adjoining cylindrical portion having a diameter greater than the inside diameter of the burr and a cylindrical portion length approximately equal to the value l satisfying the relationship $$1 \leqq \frac{S_v\sqrt{3}}{m} - 2\ln\frac{S_k}{S_v}$$

where m is the coefficient of friction between said portions and the burr wall, and then extruding the burr by passing, the punch through the die supported burr.

2. A method as claimed in claim 1, wherein said selecting step includes selecting the punch to have a further conical portion adjoining said cylindrical portion, said further portion tapering to a diameter less than the diameter of the cylindrical portion and having a half apex angle between 3° and 7°.

3. A method as claimed in claim 1, wherein said selecting step includes selecting the die and the punch diameters for a first extruding operation after the burr has been formed, such that the burr wall thickness after the first extruding operation satisfies the relationship $$S_v \leqq S_o\sqrt{do/(ds-S_o)}$$

where $S_o$=sheet thickness $d_o$=hole diameter before burring $d_s$=burr inner diameter before extruding.

4. A method as claimed in claim 1, wherein said selecting step includes selecting a punch having a coefficient of friction between said portions and the burr with a maximum value of 1.

5. A sheet having at least one hole having a burred edge extruded in accordance with the method claimed in claim 1.

6. A method as claimed in claim 1 wherein $$1 \leqq \frac{S_v\sqrt{3}}{m} - 2\ln\frac{S_k}{S_v}$$

* * * * *

UNITED STATES PATENT OFFICE

CERTIFICATE OF CORRECTION

Patent No. 4,213,323 Dated July 22,1980

Inventor(s) Johannes A.G. De Deugd

It is certified that error appears in the above-identified patent and that said Letters Patent are hereby corrected as shown below:

Col. 4, Claim 3, Change " $S_v \leqq S_o \sqrt{do/(ds-S_o)}$ "

to read -- $S_v \leqq S_o \sqrt{d_o/(d_s - S_o)}$ --

Col. 4, Claim 6, Change " $1 \leqq \frac{S_v\sqrt{3}}{m} - 2 \ln \frac{S_k}{S_v}$ "

to read -- $1 = \frac{S_v\sqrt{3}}{m} - 2 \ln \frac{S_k}{S_v}$ --

Signed and Sealed this

Tenth Day of March 1981

[SEAL]

Attest:

RENE D. TEGTMEYER

Attesting Officer

Acting Commissioner of Patents and Trademarks